US011351430B2

(12) United States Patent
Maeng et al.

(10) Patent No.: US 11,351,430 B2
(45) Date of Patent: Jun. 7, 2022

(54) CLUB COVER HAVING VARIABLE INTERNAL SPACE

(71) Applicants: Seop Maeng, Gyeonggi-do (KR); Seoe Young Maeng, Seoul (KR)

(72) Inventors: Seop Maeng, Gyeonggi-do (KR); Seoe Young Maeng, Seoul (KR)

( * ) Notice: Subject to any disclaimer, the term of this patent is extended or adjusted under 35 U.S.C. 154(b) by 94 days.

(21) Appl. No.: 16/782,299

(22) Filed: Feb. 5, 2020

(65) Prior Publication Data

US 2020/0254317 A1 Aug. 13, 2020

(30) Foreign Application Priority Data

Feb. 7, 2019 (KR) ..... 10-2019-0014293

(51) Int. Cl.
*A63B 60/62* (2015.01)

(52) U.S. Cl.
CPC ..... *A63B 60/62* (2015.10); *A63B 2209/08* (2013.01); *A63B 2209/10* (2013.01)

(58) Field of Classification Search
CPC .. A63B 60/62; A63B 2209/08; A63B 2209/10
See application file for complete search history.

(56) References Cited

U.S. PATENT DOCUMENTS 6,085,814 A * 7/2000 Choe ..... A63B 60/62 150/160
7,993,256 B2 8/2011 Takita et al.
2005/0016648 A1 1/2005 Vakharia et al.
2009/0188594 A1* 7/2009 Cameron ..... A63B 57/207 150/160
2015/0027604 A1* 1/2015 James ..... A63B 60/62 150/160
2015/0083291 A1* 3/2015 Solheim ..... A63B 60/64 150/160
2020/0254317 A1* 8/2020 Maeng ..... A63B 60/62
2021/0170249 A1* 6/2021 Maeng ..... A63B 60/62

FOREIGN PATENT DOCUMENTS

JP 2000-245882 A 9/2000
JP 2005-34650 A 2/2005
KR 19990014426 A * 2/1999 ..... A63B 60/62
KR 10-2005-0123150 A 12/2005

OTHER PUBLICATIONS

English Abstract of JP 2000-245882 A published Sep. 12, 2000.

* cited by examiner

*Primary Examiner* — Raleigh W Chiu
(74) *Attorney, Agent, or Firm* — Millen, White, Zelano & Branigan, PC; Ryan Pool

(57) ABSTRACT

A club cover is provided by being configured to be flexible in an entrance space part thereof, through which a golf club head (hereinbelow referred to as "a club head") is inserted into and withdrawn from the club cover. More particularly, a club cover having variable internal space is provided by being configured to be flexible in an entrance space part thereof, wherein when the club head is inserted into the club cover, the club head is in the club cover with the entrance space part of a body part being folded by a foldable part provided on a side surface of the body part to protect the club head, but when the club head is withdrawn, the foldable part is unfolded to expand the entrance space part, so that the club head is easily withdrawn and stored, which is easily manipulated by one hand.

5 Claims, 8 Drawing Sheets

CLUB COVER HAVING VARIABLE INTERNAL SPACE

CROSS REFERENCE TO RELATED APPLICATION

The present application claims priority to Korean Patent Application No. 10-2019-0014293, filed Feb. 7, 2019, the entire contents of which is incorporated herein for all purposes by this reference.

BACKGROUND OF THE INVENTION

Field of the Invention

The present invention generally relates to a club cover having variable internal space by being configured to be flexible in an entrance space part thereof, through which a golf club head (hereinbelow referred to as "a club head") is inserted into and withdrawn from the club cover. More particularly, the present invention relates to a club cover having variable internal space by being configured to be flexible in an entrance space part thereof, wherein when the club head is inserted into the club cover, the club head is in the club cover with an entrance space part of a body part being folded by a foldable part provided on a side surface of the body part to protect the club head, and when the club head is withdrawn, the foldable part of the body part is unfolded to expand the entrance space part, so that the club head is easily withdrawn and stored, which is easily operated by one hand. Accordingly, the club cover allows the club head to be safely stored without damage and is low in manufacturing cost, so consumers can use the club cover conveniently and financial burden. In addition, when multiple club covers are used at the same time, the size of the entrance space part of a lower end of each of the club covers is decreased, so interference between the club covers is minimized.

Description of the Related Art

Generally, the size of the golf club used as "a driver club" among the golf clubs has been about 300 cc in volume, but the size of the golf club has gradually increased, and recently the size of the golf club has been enlarged to a size of about 500 cc in volume. However, a club cover used to protect the surface of the golf club could be manufactured up to a size of 350 cc when using materials such as flexible knit products. However, the club cover made of the knit products is not used at present as the volume of the club is increasing to 500 cc.

Accordingly, currently, a club cover, which is sewn with a general fabric or synthetic resin leather, is used to cover a club head.

As for such a conventional club cover, as illustrated in FIG. 1, the size of an entrance space part arranged at a lower part of the club cover is considerably big such that the head is efficiently inserted to and withdrawn from the club cover when inserting the big head of a golf club into the club cover, which results in the entrance space part drooping. Accordingly, when a plurality of golf clubs covered by club covers are stored in a golf bag, interference between the entrance space parts of the club covers, which are drooped, occurs, which causes much inconvenience during use. A rubber band is provided at an upper end of the entrance space part such that the club head does not fall out. Such a rubber band makes the passing of the club head through a head storage space difficult, which causes the passing to take much time. In addition, when golf clubs are carried in a golf bag, the golf clubs may collide with and damage each other in the golf bag, or may overlap each other and the club heads of the golf clubs, which are loaded, collide with each other and are frequently damaged.

DOCUMENT OF RELATED ART (Patent Document 1) Korean Utility Model Registration No. 20-0162849

SUMMARY OF THE INVENTION

Accordingly, the present invention has been made keeping in mind the above problems occurring in the related art, and the present invention is intended to propose a club cover having variable internal space by being configured to be flexible in an entrance space part thereof, which is more conveniently used than conventional club covers when putting the club cover on the club head to protect the club head and when removing the club cover from the club head to use a golf club, low in manufacturing costs, and excellent in quality, and further is more conveniently used due to manipulability by one hand and interference between club covers is minimized.

The present invention is further intended to propose a club cover having variable internal space by being configured to be flexible in an entrance space part thereof, wherein when an external force is applied to a foldable part provided on a side surface of a body part of the club cover in an unfolding direction thereof, the foldable part, which is folded, is unfolded and the entrance space part of the club cover is expanded to insert the club head thereto, but when an external force is applied to the foldable part in a folding direction thereof, the size of the entrance space part is easily decreased, thereby making the use of the club cover convenient.

In order to achieve the above objectives, according to one aspect of the present invention, there is provided the club cover having variable internal space by being configured to be flexible in an entrance space part thereof, the club cover including: a head storage space provided at an upper part of the club cover, the head storage space storing the club head; a body part provided from a middle part to a lower part of the club cover and which the club head is inserted into and withdrawn from; the entrance space part provided inside the body part and configured to be wide so as to easily pass the club head therethrough; and foldable parts provided at opposite sides of the body part and having one or more creases configured inward toward a center of the body part.

According to the club cover having variable internal space by being configured to be flexible in the entrance space part thereof according to the present invention, magnets are mounted to opposing positions of edges of the foldable parts, and the size of the entrance space part of the body part is decreased and increased while the magnets are attached to and separated from each other. Accordingly, the club head is easily inserted into the head storage space, so the club cover is excellent in usability. In addition, since the club cover has a simple structure, is easy to manipulate for an intended purpose, and simply manufactured, the club cover can be produced at low cost so consumers can have many benefits.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
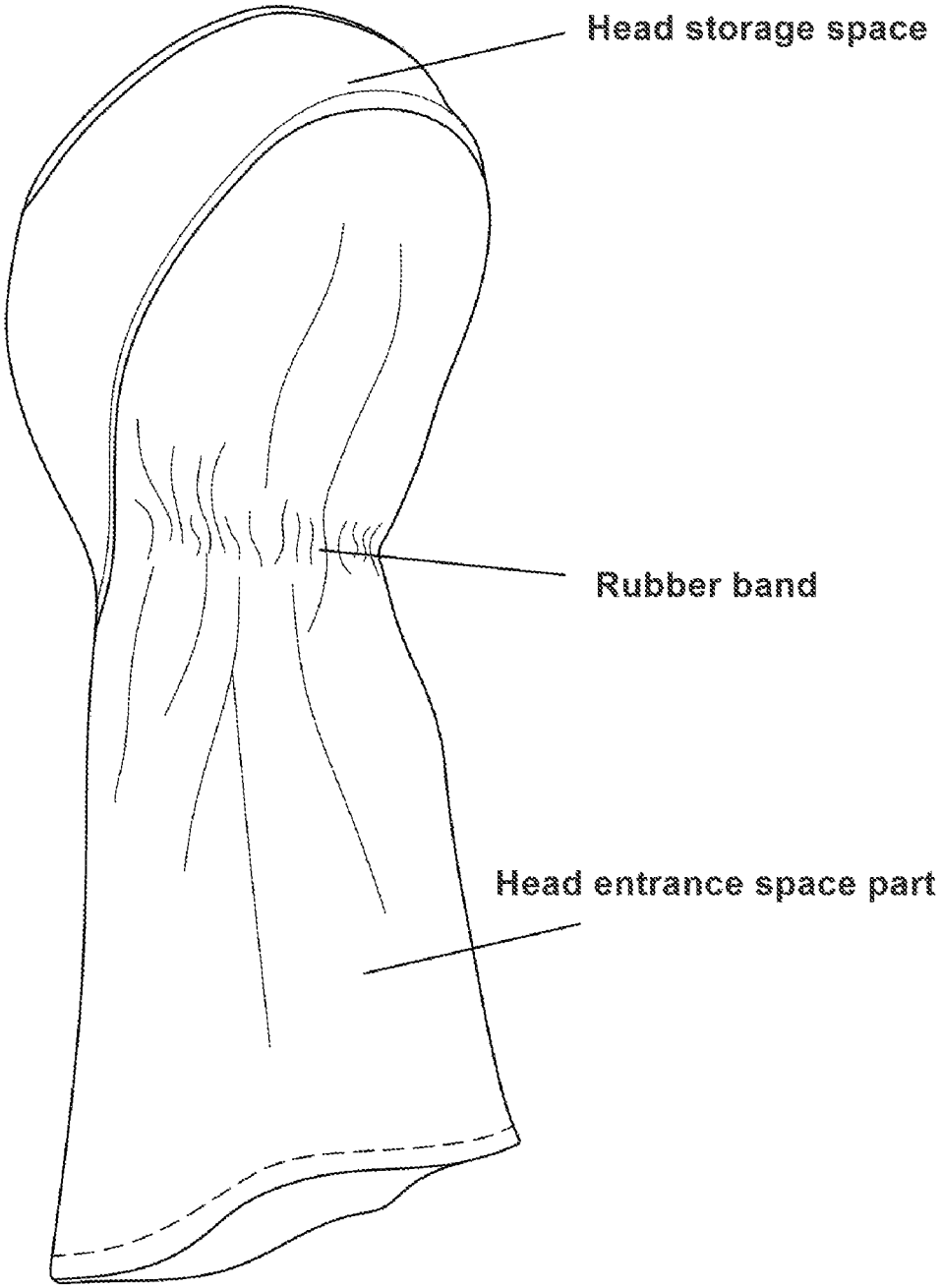
FIG. 1 is a perspective view of a conventional club cover.
Figure 2:
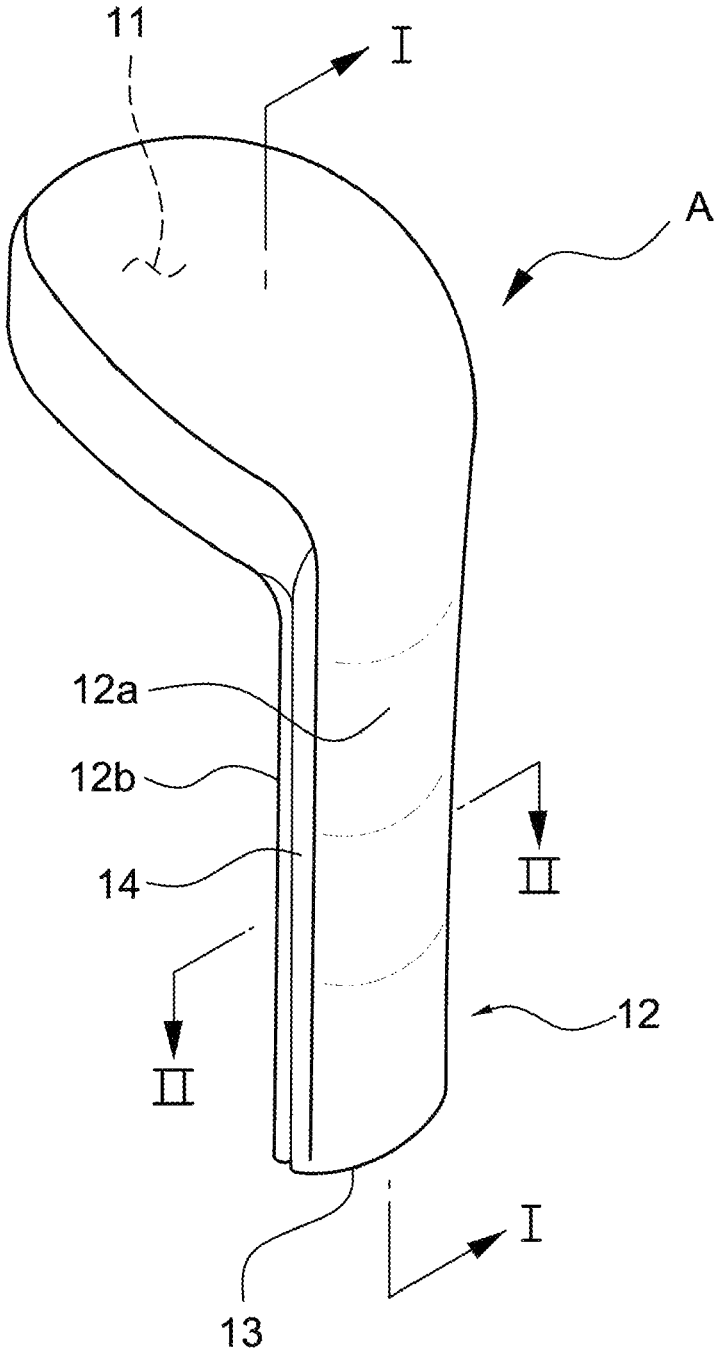
FIG. 2 is a perspective view of a club cover according to a first embodiment of the present invention.
Figure 3:
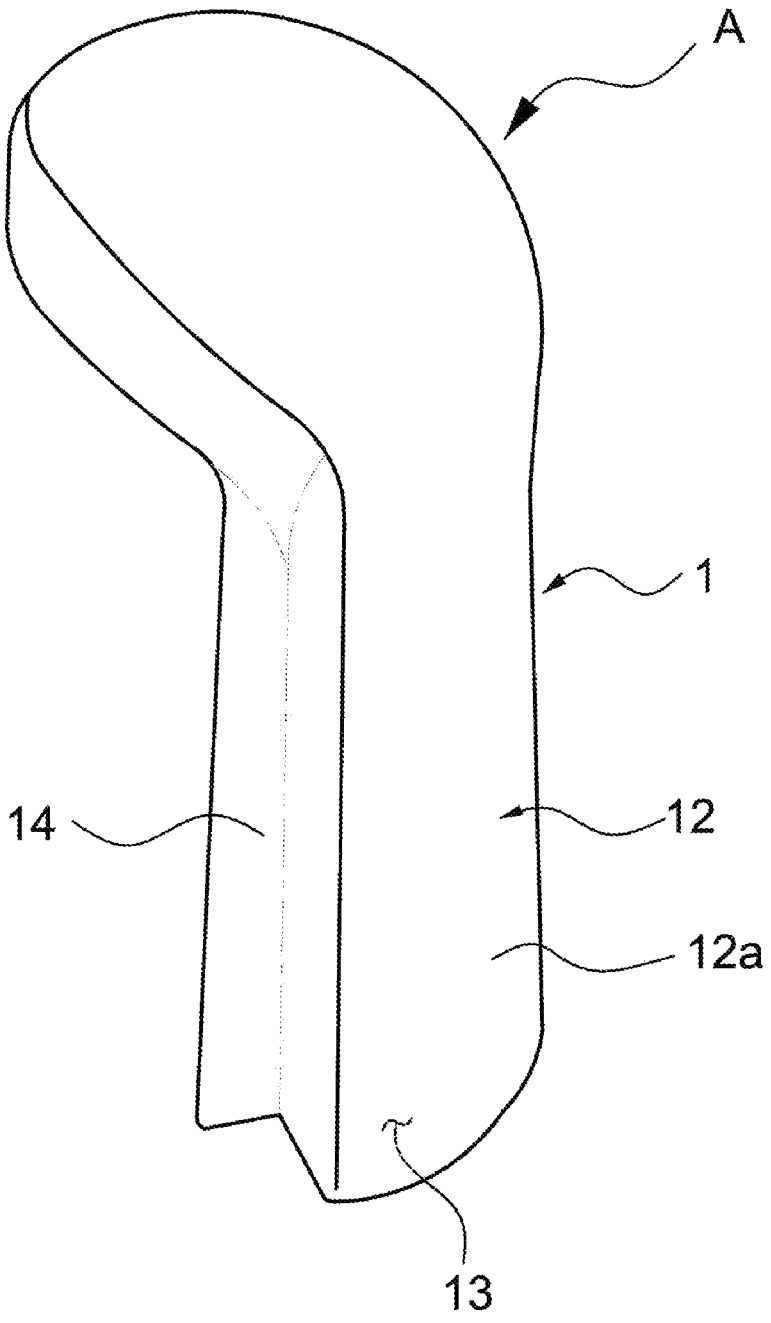
FIG. 3 is a perspective view of the club cover unfolded by being expanded according to the first embodiment of the present invention.
Figure 4A:
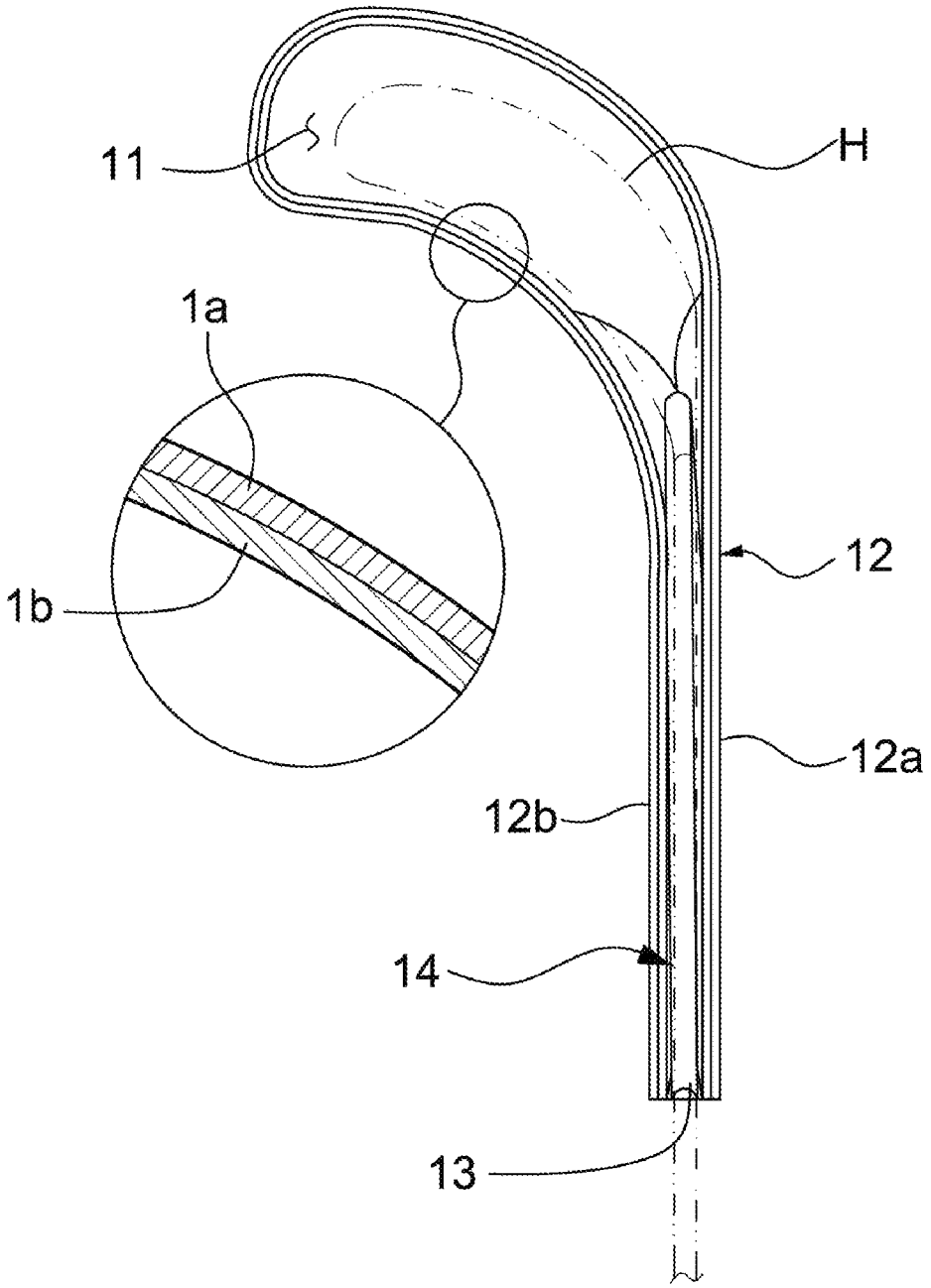
FIGS. 4A and 4B are a sectional view and a cross-sectional view taken along line I-I and line II-II of FIG. 2, respectively.
Figure 4B:
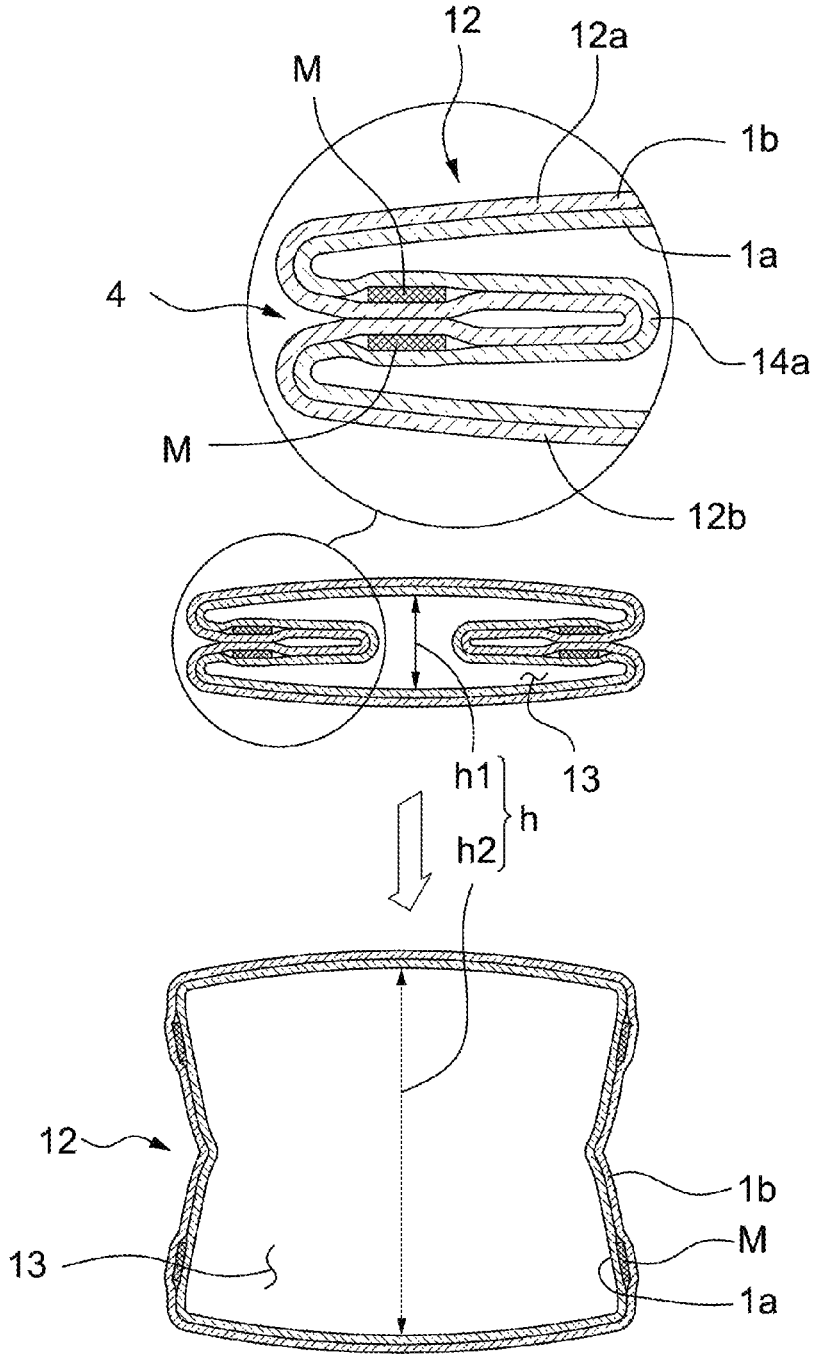

As illustrated in FIGS. 2 to 4B, a club cover A having variable internal space by being configured to be flexible in an entrance space part thereof according to a first embodiment of the present invention consists of a lining 1*a* and an outer fabric 1*b* and includes: a head storage space 11 provided at an upper part of the club cover, the head storage space storing the club head H; a body part 12 provided from a middle to a lower part of the club cover and which the club head is inserted into and withdrawn from; the entrance space part 13 provided inside the body part 12, the entrance space part being configured to be wide and to be contracted and expanded so as to easily pass the club head therethrough; and foldable parts 14 provided at opposite sides of the body part 12 and having one or more creases configured inward toward a center of the body part 12.

In the embodiment of the present invention, the body part 12 is configured to have a front surface 12*a*, a rear surface 12*b*, and the foldable parts 14 arranged at the opposite sides of the body part between the front surface 12*a* and the rear surface 12*b*.

In the embodiment of the present invention, as for the foldable part 14, a pair of foldable parts 14 are provided at the opposite sides of the body part 12 and the entrance space part 13. One crease 14*a* is formed at each of the foldable parts 14 but is not limited thereto. The foldable part 14 may be formed at only one side of each of the body part 12 and the entrance space part 13 and one or more creases 14*a* may be formed at each of the foldable parts 14.

In the embodiment of the present invention, when the club head H is inserted into the club cover, a creased part of the crease 14*a* of the foldable part 14 is spread and a width h of each of the body part 12 and an entrance of the entrance space part 13 is increased from a width h1 of the body part 12 during the folding of the foldable part to a width h2 thereof during the unfolding of thereof, so the club head H is efficiently inserted into the club cover and is stored in the head storage space 11. Accordingly, while the club head H is stored in the head storage space, the spread crease 14*a* of the foldable part 14 is creased back to an initial position, and the width h of the body part 12 is decreased to the width h1 thereof during the folding of the foldable part, so interference with other golf clubs is prevented and the club head is efficiently stored.

Figure 5A:
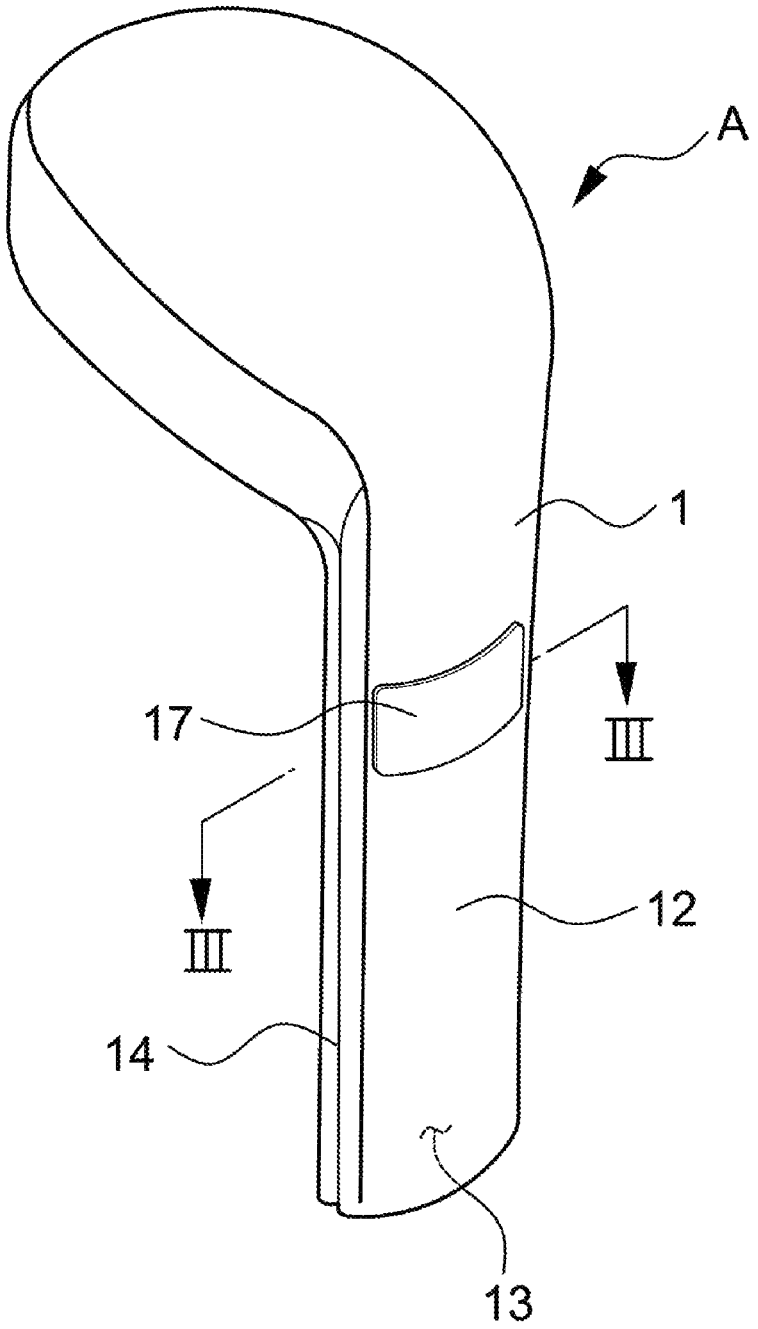
FIGS. 5A and 5B are a perspective view of a club cover and a cross-sectional view and a partially enlarged cross-sectional view during folding taken along line III-III of FIG. 5A according to a second embodiment of the present invention.
Figure 5B:
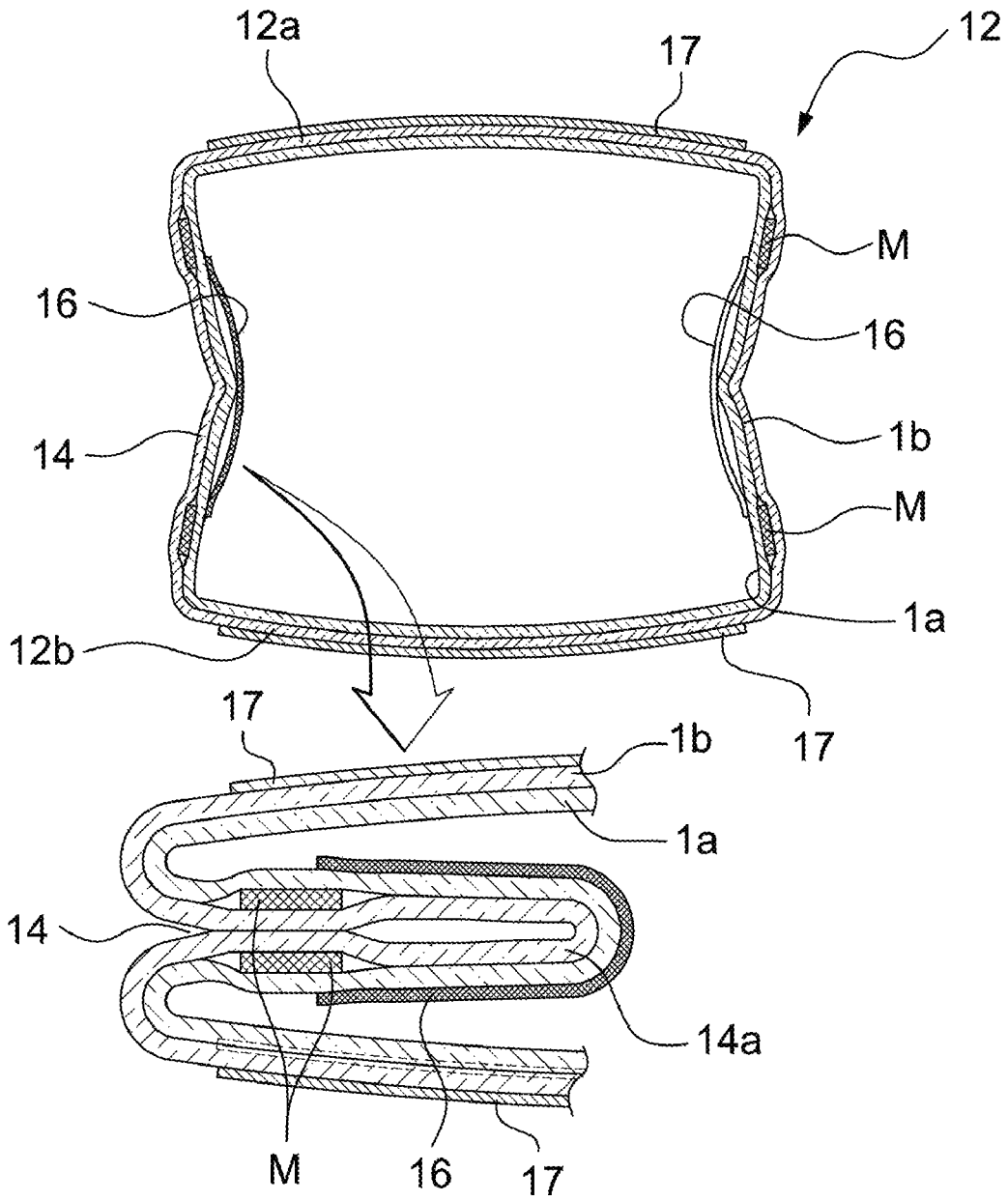

FIGS. 5A and 5B are a perspective view of the club cover and a cross-sectional view and a partially enlarged cross-sectional view during contraction taken along line III-III of FIG. 5A according to a second embodiment of the present invention As illustrated in the drawings, at least one foldable part 14, which is folded, is provided in the body part 12 of the middle of a club cover main body 1 inward toward the center of the body part 12. Magnets M are attached to the edges of opposite sides of the foldable part 14, the magnets creasing the crease 14*a* of the foldable part 14, and a narrow and long rubber plate 16 is provided behind the magnets M and fixed to the foldable part 14 by extending in a transverse direction thereof, the rubber plate surrounding the crease 14*a* of the foldable part 14. When the club head H is stored, the foldable part 14 is folded and portions of the foldable part 14, which is folded, are attached to each other by the magnets M while being folded. The crease 14*a* of the foldable part 14 in the folded state functions to store and maintain the club head more effectively than a rubber band fixing the club head of an existing club cover. When unfolding the club cover main body 1 to be used, the attachment between the magnets M is released, and the narrow and long rubber plate 16 is unfolded, so the foldable part 14 of the club cover main body 1 is spread to be completely unfolded.

As illustrated in FIG. 5B, a handle 17 is provided at the front surface of the body part 12 of the middle of the club cover main body 1 to be conveniently grasped by a user, the handle preventing the body part from being deformed due to the attachment of the magnets by an attachment force occurring therebetween, so the club cover A can be easily grasped. In addition, the handle 17 is provided in the rear surface and prevents the body part from being deformed by the attachment force of the magnets M of the body part 12. The handle 17 is provided at a front surface and a rear surface of a middle portion of the body part 12 at predetermined positions, and functions to maintain shapes of the front surface and the rear surface and to prevent attachment between the magnets M disposed on the same horizontal surfaces as the front surface and the rear surface.

Accordingly, when storing the club head H in the head storage space 11, the handle 17 of the body part 12 of the middle of the club cover main body 1 is grasped and an external force is applied to the crease 14*a* of the foldable part 14. In this case, a detachment force is applied to the pair of magnets M disposed at the edges of the foldable part 14 and the magnets M are separated from each other. At the same time when the magnets M are separated from each other, the narrow and long rubber plate 16 is unfolded from the folded state by an unfolding force of the narrow and long rubber plate 16, which is folded. When the crease 14*a*, which is folded, is spread, the size of the space of each of the body part 12 and the entrance space part 13 is increased to the width h2. Accordingly, the expanded space, in which the club head H can be stored, is obtained.

In this state, when the club head H passes through the body part 12 and the entrance space part 13, which are expanded, and is introduced to the head storage space 11 of the club cover main body 1, the external force is released such that the magnets M, which are separated from each other, are attached to each other. In this case, the separated magnets M are attached to each other and the crease 14*a* of the unfolded foldable part 14 is also restored to a creased position, which is an initial position. Accordingly, the width h of the body part 12 is decreased to the width h1 during the folding, so interference with other club covers is prevented. Accordingly, the golf club is conveniently stored.

Figure 6:
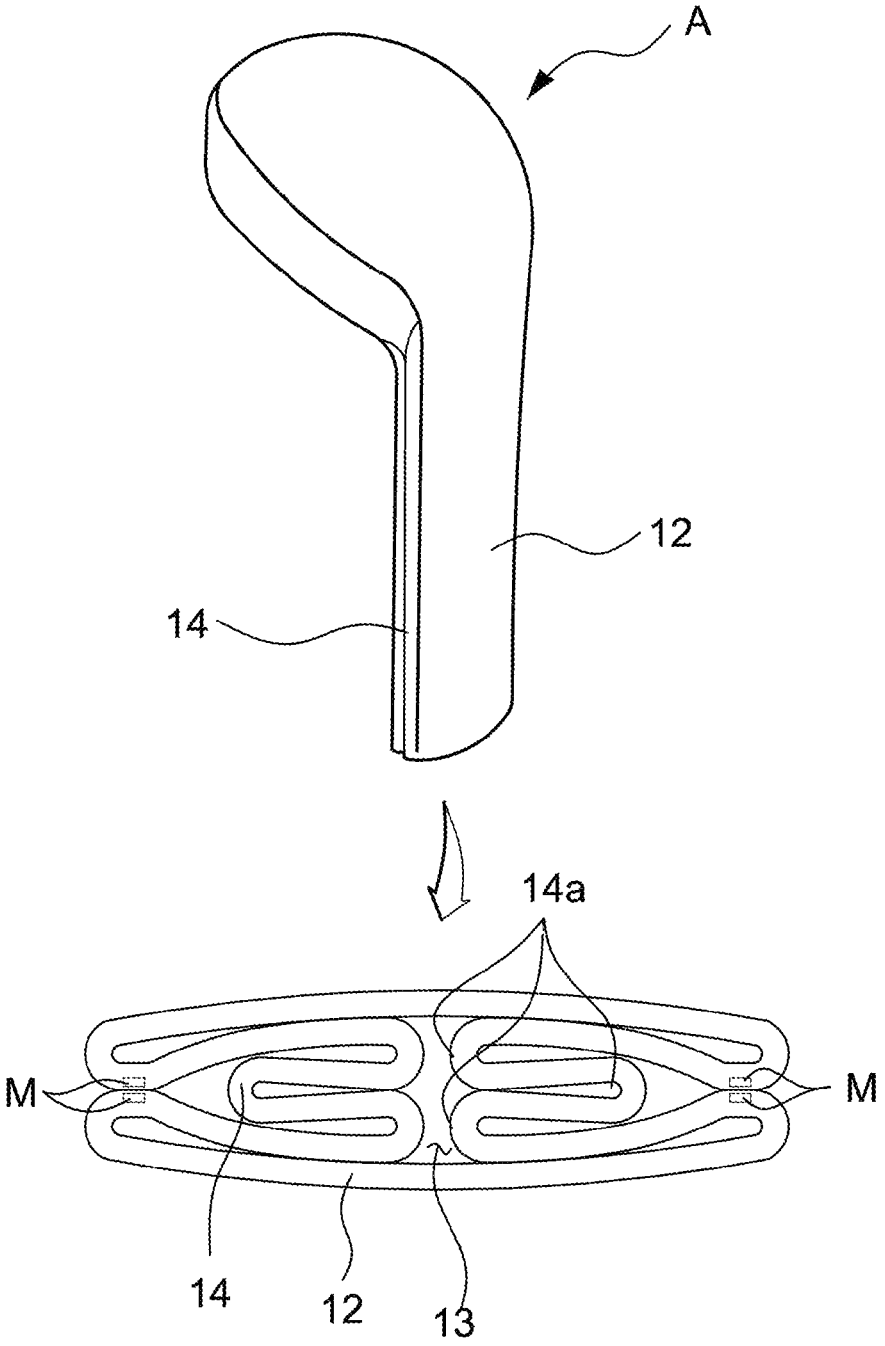
FIG. 6 is a perspective view of a club cover and a bottom view of an entrance space part thereof seen upward according to a third embodiment of the present invention.

FIG. 6 is a perspective view of a club cover and a bottom view of the entrance space part thereof seen upward according to a third embodiment of the present invention. The club cover A of the third embodiment of the present invention includes foldable parts 14 provided in the body part 12, which the club head is inserted into and withdrawn from, and magnets M are attached to inner sides of opposite edges of the foldable parts 14. The width of the entrance space part 13 of the golf club is configured to be increased and decreased by the detachment/attachment of the magnets M. Each of the foldable parts 14 has three creases 14*a* provided therein. Accordingly, the entrance space part 13 is configured to be bigger in a width h during unfolding of the foldable parts 14. Since the foldable part 14 has a plurality of creases 14*a* formed therein, the width of the entrance space part can be more quickly decreased or increased and the foldable part is easily operated even by a small amount of an external force.

Although the foldable part 14 is described to be provided in the embodiment, it is possible to use a simple structure in which the foldable part 14 is cut out without using the foldable part 14. In addition, although not shown, it is also possible to substitute other materials such as Velcro tape, which can be freely attached and detached, without using the magnets M.

The club cover having variable internal space by being configured to be flexible in the entrance space part thereof according to the present invention can be efficiently applicable to the club cover manufacturing industry, since it is possible to manufacture homogeneous products in the club cover manufacturing industry.

What is claimed is:

1. A club cover (A) having variable internal space, the club cover comprising:

a head storage space (11) provided at an upper part of the club cover, the head storage space storing a club head (H);

a body part (12) provided from a middle part to a lower part of the club cover and through which the club head is inserted into and withdrawn from the head storage space;

an entrance space part (13) provided inside the body part (12), the entrance space part being configured to be contracted and expanded so as to easily pass the club head therethrough; and a foldable part (14) provided at each side of the body part (12) and having at least one crease configured to be retracted inward toward a center of each of the body part (12) and the entrance space part (13), wherein magnets (M) are attached to edges of the foldable part (14) such that the crease of the foldable part (14) is maintained in a retracted state.

2. The club cover of claim 1, wherein one, two, or three creases are provided in the foldable part (14).

3. The club cover of claim 1, wherein one, two, or three creases are provided in the foldable part (14).

4. The club cover of claim 1, further comprising:

a handle (17) provided at each of a front surface and a rear surface of a middle portion of the body part (12) at predetermined positions, the handle (17) maintaining shapes of the front surface and the rear surface and preventing attachment between the magnets (M) disposed on the same horizontal surfaces as the front surface and the rear surface.

5. The club cover of claim 1, wherein a hook and loop fastener tape, which is attachable and detachable, is provided at each of the edges of the foldable part (14) instead of using the magnets (M).

* * * * *